US008926141B2

(12) United States Patent
Yeh

(10) Patent No.: US 8,926,141 B2
(45) Date of Patent: Jan. 6, 2015

(54) COMBINATION LED LAMP AND HEAT SINK STRUCTURE

(71) Applicant: Chao-Chin Yeh, Tianzhong Township, Changhua County (TW)

(72) Inventor: Chao-Chin Yeh, Tianzhong Township, Changhua County (TW)

( * ) Notice: Subject to any disclaimer, the term of this patent is extended or adjusted under 35 U.S.C. 154(b) by 140 days.

(21) Appl. No.: 13/692,765

(22) Filed: Dec. 3, 2012

(65) Prior Publication Data

US 2014/0153248 A1 Jun. 5, 2014

(51) Int. Cl.
*F21V 29/00* (2006.01)
*F21Y 101/02* (2006.01)

(52) U.S. Cl.
CPC ..... *F21V 29/262* (2013.01); *F21Y 2101/02* (2013.01)
USPC ..... 362/294; 362/373

(58) Field of Classification Search
USPC ..... 362/294, 373
See application file for complete search history.

(56) References Cited

U.S. PATENT DOCUMENTS

2009/0316404 A1* 12/2009 Mo et al. ..... 362/249.01

* cited by examiner

*Primary Examiner* — Anh Mai
*Assistant Examiner* — Meghan Dunwiddie
(74) *Attorney, Agent, or Firm* — Muncy, Geissler, Olds & Lowe, P.C.

(57) ABSTRACT

A combination LED lamp and heat sink structure includes a heat sink formed by bending or stamping a metal sheet member into shape to provide a plurality of upright walls and mounting holes, a circuit board carrying a LED or LEDs at the front side and having a plurality of through holes, a plurality of metal connection members mounted in the mounting holes and the through holes to fixedly connect the heat sink and the circuit board together, and a lampshade surrounding the circuit board to let the heat sink be exposed to the outside.

8 Claims, 6 Drawing Sheets

COMBINATION LED LAMP AND HEAT SINK STRUCTURE

BACKGROUND OF THE INVENTION

1. Field of the Invention

The present invention relates to LED technology and more particularly, to a combination LED lamp and heat sink structure.

2. Description of the Related Art

For the purpose of energy saving and carbon reduction, LED lamps are created. These commercial LED lamps achieve energy saving; however, they commonly have a heat dissipation problem. To facilitate quick dissipation of waste heat, a LED lamp may be combined with a heat sink. Conventionally, a heat sink for LED lamp application may be directly made of a metal material using a cast molding technique, or formed by welding a plurality of metal plate members together. After formation of the heat sink, the heat sink is coated with a layer of thermal paste and then bonded to a circuit board for LED lighting fixture. However, during actual application, the plastic circuit board cannot effectively transfer waste heat to the heat sink for quick dissipation. Further, using a casting molding technique to make a heat sink has the drawback of high manufacturing cost. When employing a welding technique to fabricate a heat sink, the heat sink fabrication process has the drawbacks of complicated manufacturing process and low heat-transfer performance. Thus, a LED lighting fixture using a heat sink made according to any of the aforesaid conventional methods has a high cost, loosing market competitiveness.

SUMMARY OF THE INVENTION

The present invention has been accomplished under the circumstances in view. It is the main object of the present invention to provide a combination LED lamp and heat sink structure, which is easy to make and provides better heat dissipation performance.

To achieve this and other objects of the present invention, a combination LED lamp and heat sink structure comprises a heat sink made of a metal sheet member using a bending or stamping technique to provide a plurality of upright walls, a circuit board carrying a LED or LEDs at the front side, a plurality of metal connection members mounted in the heat sink and the circuit board together to fixedly secure them together, and a lampshade surrounding the circuit board to let the heat sink be exposed to the outside.

Other advantages and features of the present invention will be fully understood by reference to the following specification in conjunction with the accompanying drawings, in which like reference signs denote like components of structure.

DETAILED DESCRIPTION OF THE INVENTION

Figure 1:
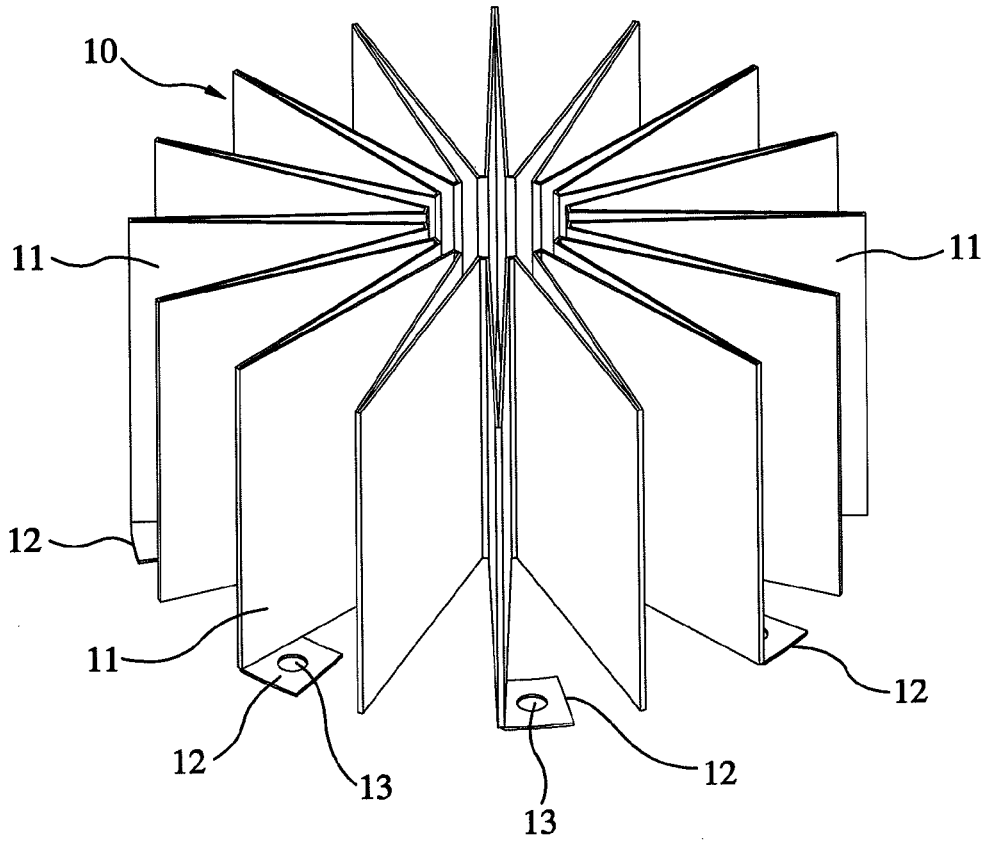
FIG. 1 is a top view view of the heat sink for combination LED lamp and heat sink structure in accordance with a first embodiment of the present invention.
Figure 2:
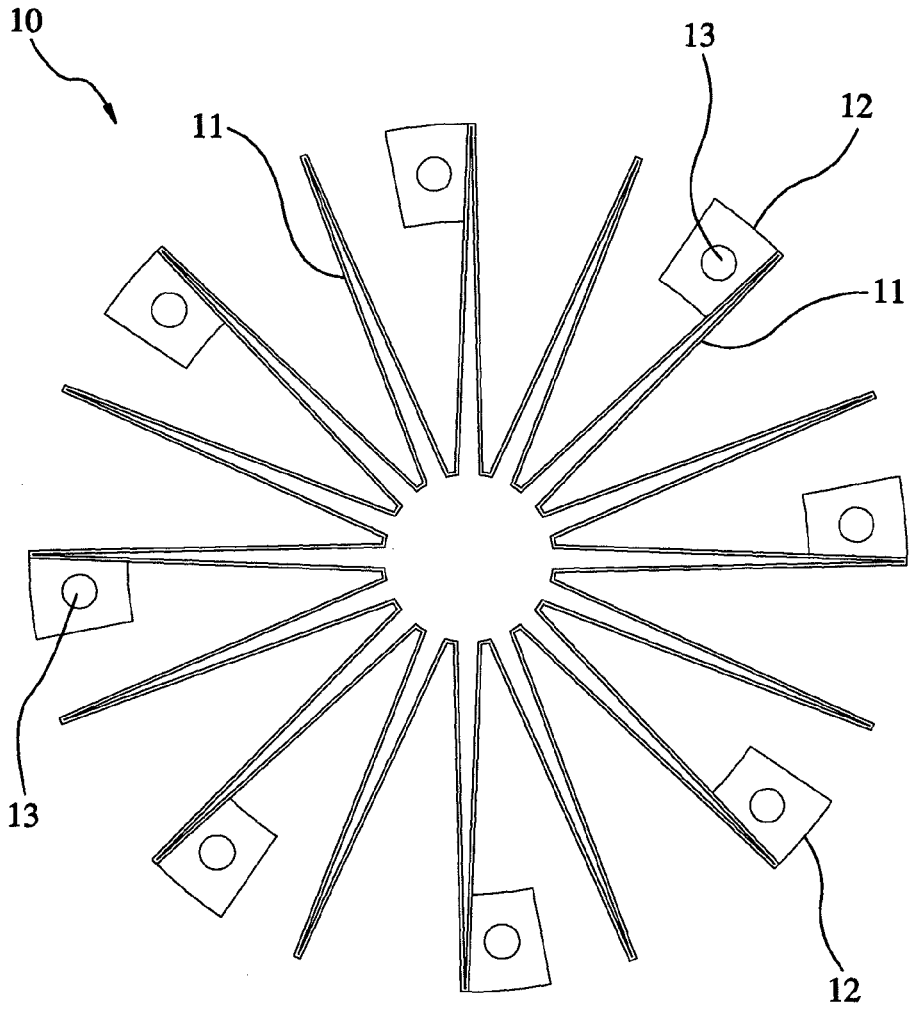
FIG. 2 is a top view of the heat sink shown in FIG. 1.
Figure 3:
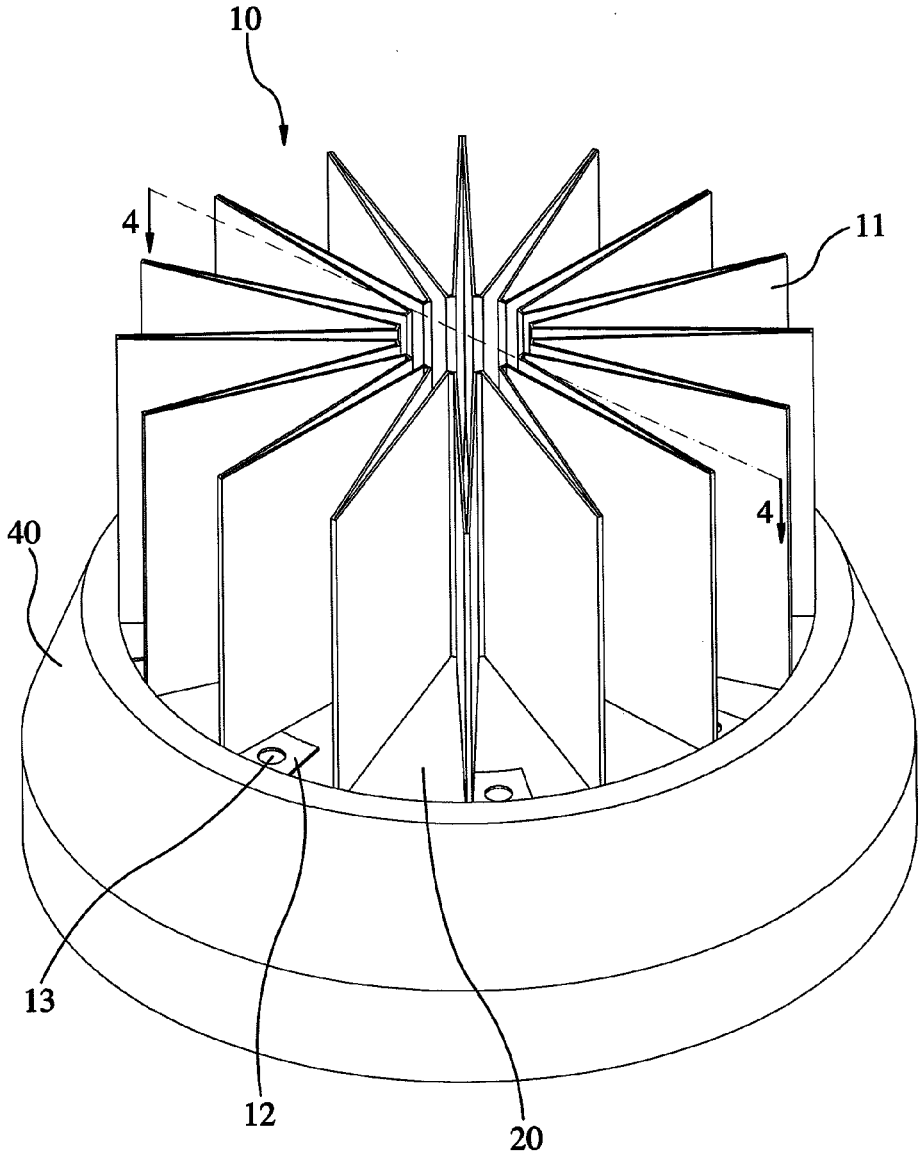
FIG. 3 is an oblique side elevation of the combination LED lamp and heat sink structure in accordance with the first embodiment of the present invention.
Figure 4:
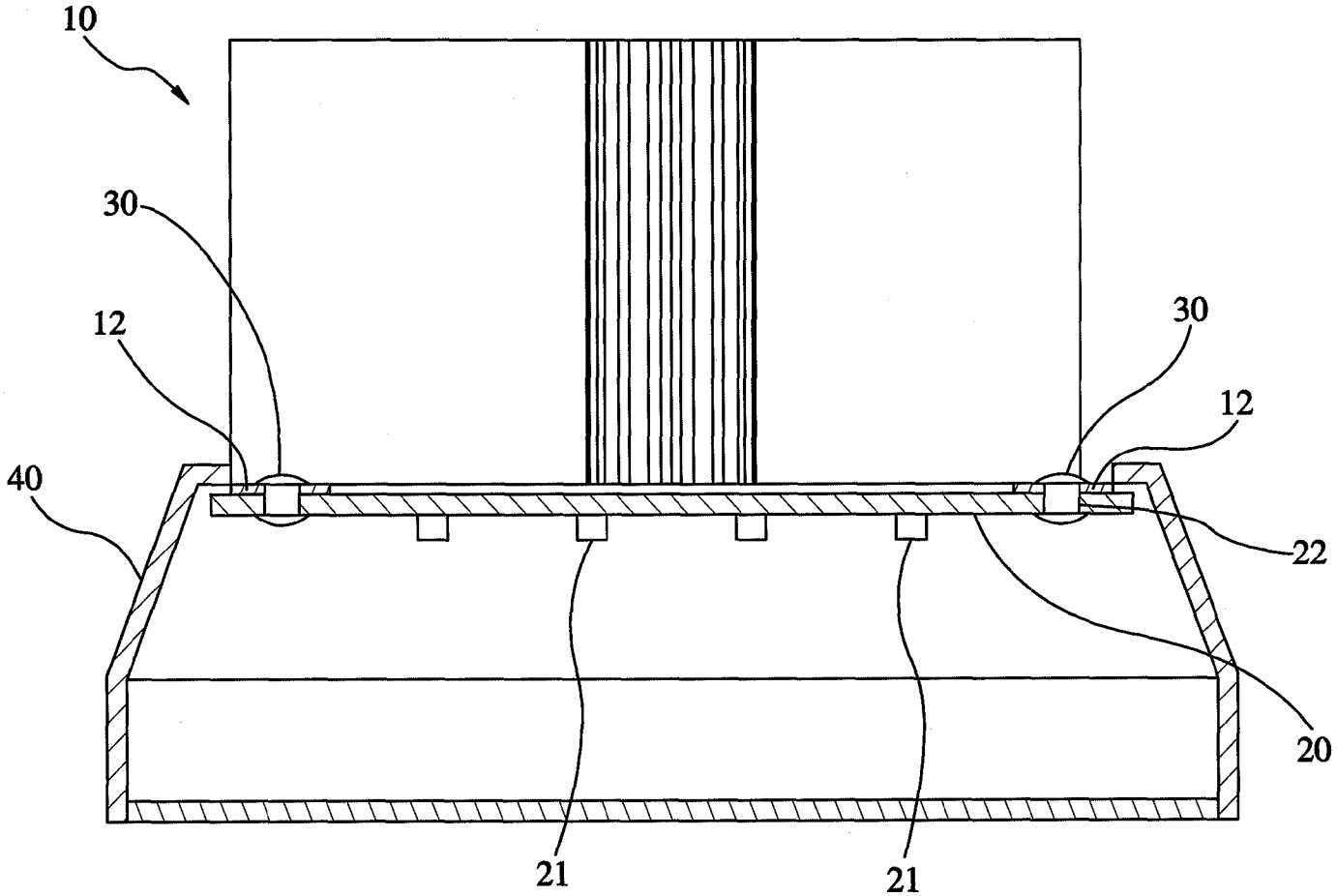
FIG. 4 is a schematic sectional view of the combination LED lamp and heat sink structure in accordance with the first embodiment of the present invention.

Referring to FIGS. 1-4, a combination LED lamp and heat sink structure in accordance with a first embodiment of the present invention is shown. The combination LED lamp and heat sink structure comprises a heat sink 10, a circuit board 20, a plurality of metal connection members 30, and a lampshade 40.

The heat sink 10 is made of a metal sheet member using a bending technique. The metal sheet member can be selected from the group of iron, copper, aluminum, and their alloys. After bent into shape, the heat sink 10 provides a three-dimensional structure of multiple upright walls 11 and a plurality of mounting holes. These mounting holes are formed at the metal sheet member directly by stamping prior to the shape bending procedure. Instead of making the heat sink by bending a single piece of metal sheet member into shape, the heat sink can be made by bending multiple sheet members into a predetermined shape and then affixing the shaped sheet members together by riveting, screwing, welding or bonding. In this first embodiment, the heat sink is made by bending an elongated metal sheet member into a three-dimensional structure having a plurality of radially arranged upright walls 11, a lug 12 at one side of each upright wall 11 and a mounting hole 13 at each lug 12. The mounting hole of each lug can be made using a stamping or drilling technique.

The circuit board 20 comprises a circuit layout (not shown) at the front side thereof, at least one LED (light-emitting diode) 21 electrically connected to the circuit layout, and a plurality of through holes 22 corresponding to the mounting holes 13 of the heat sink 10.

The metal connection members 30 are respectively mounted in the mounting holes 13 of the heat sink 10 and the through holes 22 of the circuit board 20 to fixedly secure the heat sink 10 to the circuit board 20. These metal connection members 30 can be rivets or screw bolts.

The lampshade 40 has an annular body and an open space surrounded by the annular body. The circuit board 20 is mounted in the lampshade 40. The heat sink 10 is inserted through the open space to the outside of the lampshade 40.

In this first embodiment, the invention uses rivets or screw bolts to directly affix the heat sink and the circuit board together. Because the metal connection members are inserted from the back side of the circuit board to the front side thereof, they can absorb and transfer radiating heat from the LED to the heat sink for quick dissipation. Further, because the heat sink is made by bending a metal sheet member into shape, it has a better performance in heat dissipation than a heat sink of the same capacity that is made by connecting multiple metal sheet members into shape. When compared with cast molding, the manufacturing cost of the heat sink in accordance with the first embodiment is more simple and inexpensive.

Figure 5:
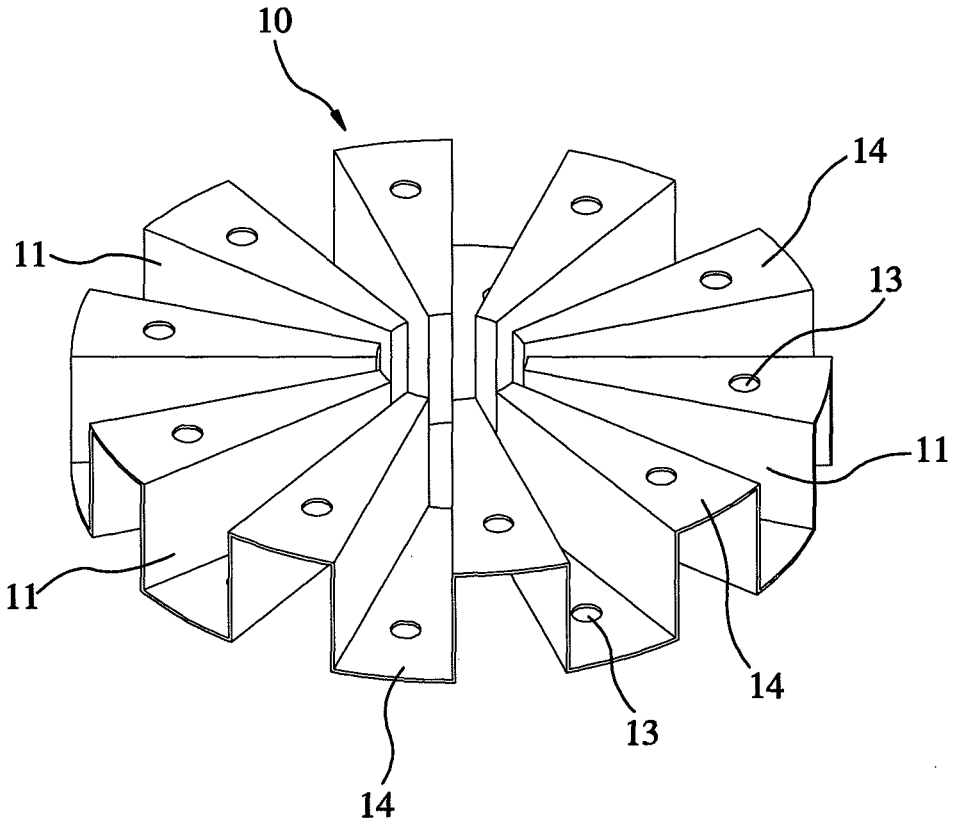
FIG. 5 is an oblique top elevation of a heat sink for combination LED lamp and heat sink structure in accordance with a second embodiment of the present invention.
Figure 6:
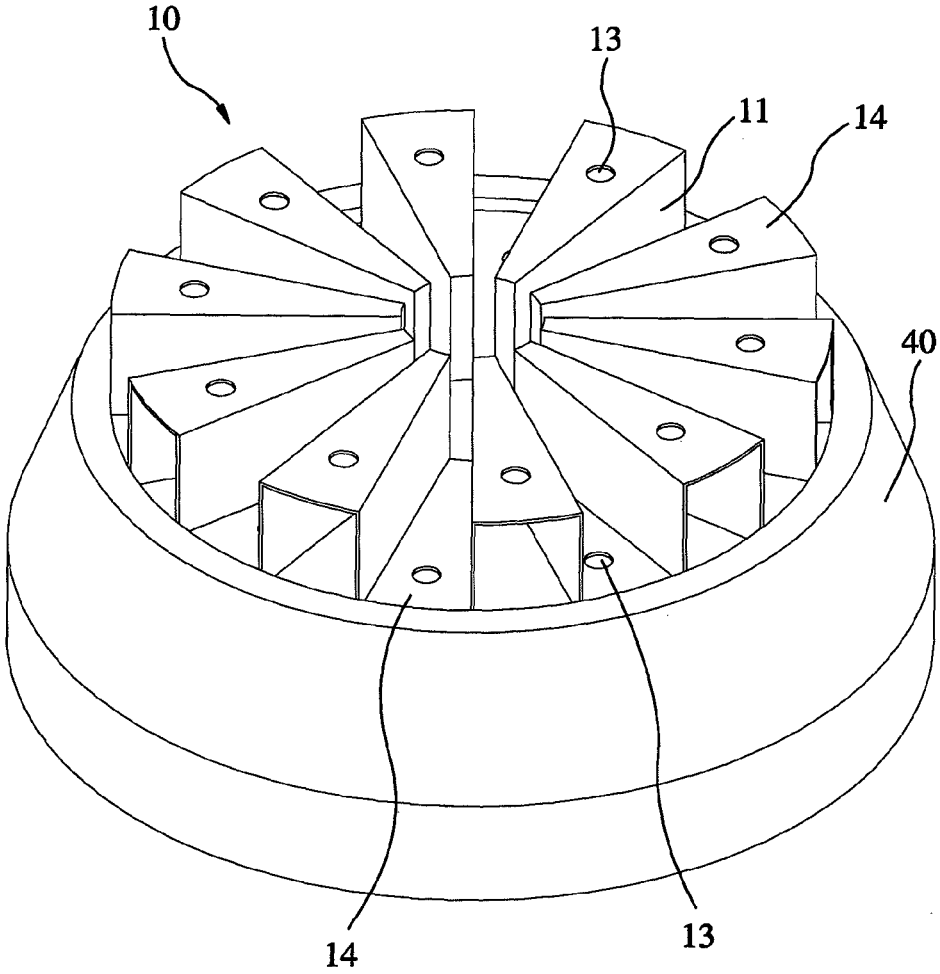
FIG. 6 is an oblique elevational view of the combination LED lamp and heat sink structure in accordance with the second embodiment of the present invention.

Referring to FIGS. 5 and 6, a combination LED lamp and heat sink structure in accordance with a second embodiment of the present invention is shown. The combination LED lamp and heat sink structure comprises a heat sink 10, a circuit board 20, a plurality of metal connection members 30, and a lampshade 40.

The heat sink 10 is made of a metal sheet member using a stamping technique. The metal sheet member can be selected from the group of iron, copper, aluminum, and their alloys. After stamped into shape, the heat sink 10 provides a multiple upright walls 11 and a plurality of mounting holes 13. These mounting holes are formed at the metal sheet member directly during the stamping process. Instead of making the heat sink by stamping a single piece of metal sheet member into shape, the heat sink can be made by stamping multiple sheet members into a predetermined shape and then affixing the shaped sheet members together by riveting, screwing, welding or bonding. In this first embodiment, the heat sink is made by stamping a metal sheet member into a plurality of vertically staggered rib structures each having two upright walls 11, a horizontal wall 14 connected between these two upright walls 11, and a mounting hole 13 at each horizontal wall 14.

The circuit board 20 comprises a circuit layout (not shown) at the front side thereof, at least one LED (light-emitting diode) 21 electrically connected to the circuit layout, and a plurality of through holes 22 corresponding to the mounting holes 13 of the heat sink 10, The metal connection members 30 are respectively mounted in the mounting holes 13 of the heat sink 10 and the through holes 22 of the circuit board 20 to fixedly secure the heat sink 10 to the circuit board 20. These metal connection members 30 can be rivets or screw bolts.

The lampshade 40 has an annular body and an open space surrounded by the annular body. The circuit board 20 is mounted in the lampshade 40. The heat sink 10 is inserted through the open space to the outside of the lampshade 40.

The connection between the heat sink and the circuit board in accordance with this second embodiment is same as the aforesaid first embodiment. Thus, the metal connection members can absorb and transfer radiating heat from the LED to the heat sink for quick dissipation. Further, because the heat sink is made by bending a metal sheet member into shape, it has a better performance in heat dissipation than a heat sink of the same capacity that is made by connecting multiple metal sheet members into shape. When compared with cast molding, the manufacturing cost of the heat sink in accordance with the first embodiment is more simple and inexpensive.

Further, there are no restrictions on the number of the mounting holes at the heat sink. In the aforesaid first embodiment, a lug and a mounting hole are set at each bent. In the aforesaid second embodiment, a mounting hole is made at each horizontal wall.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A combination LED lamp and heat sink structure, comprising:

a heat sink made of at least one metal sheet member being curved into a predetermined shape, said heat sink comprising a plurality of upright walls and a plurality of mounting holes, said mounting holes being directly formed in said metal sheet member;

a circuit board comprising a circuit layout located at a front side thereof, at least one LED (light-emitting diode) electrically connected to said circuit layout, and a plurality of through holes;

a plurality of metal connection members respectively mounted in said mounting holes of said heat sink and said through holes of said circuit board to fixedly secure said heat sink to said circuit board; and a lampshade comprising a body surrounding said circuit board and an open space surrounded by said body for the passing of said heat sink to the outside of said lampshade, wherein said heat sink is made by continuously bending an elongated metal sheet member into said upright walls in a radial manner.

2. The combination LED lamp and heat sink structure as claimed in claim 1, wherein said heat sink comprises a plurality of lugs respectively extended from said upright walls; the mounting holes of said heat sink are respectively located at said lugs.

3. The combination LED lamp and heat sink structure as claimed in claim 2, wherein each said lug is located at one respective bent of said upright walls; each said mounting hole is located at one respective said lug.

4. The combination LED lamp and heat sink structure as claimed in claim 1, wherein said metal connection members are rivets.

5. The combination LED lamp and heat sink structure as claimed in claim 1, wherein said heat sink is made of curving a single piece of metal sheet member into shape.

6. The combination LED lamp and heat sink structure as claimed in claim 1, wherein said heat sink is made of curving multiple pieces of metal sheet members into a predetermined shape and then affixing these shaped multiple pieces of metal sheet members together.

7. A combination LED lamp and heat sink structure, comprising:

a heat sink made of at least one metal sheet member being, curved into a predetermined shape, said heat sink comprising a plurality of upright walls and a plurality of mounting holes, said mounting holes being directly formed in said metal sheet member;

a circuit board comprising a circuit layout located at a front side thereof, at least one LED (light-emitting diode) electrically connected to said circuit layout, and a plurality of through holes;

a plurality of metal connection members respectively mounted in said mounting holes of said heat sink and said through holes of said circuit board to fixedly secure said heat sink to said circuit board; and a lampshade comprising a body surrounding said circuit board and an open space surrounded by said body for the passing of said heat sink to the outside of said lampshade, wherein said through holes of said circuit board are respectively disposed at locations corresponding to the mounting holes of said heat sink.

8. A combination LED lamp and heat sink structure, comprising:

a heat sink made of at least one metal sheet member being curved into a predetermined shape, said heat sink comprising a plurality of upright and a plurality of mounting holes, said mounting holes being directly formed in said metal sheet member;

a circuit board comprising a circuit layout located at a front side thereof, at least one LED (light-emitting diode) electrically connected to said circuit layout, and a plurality of through holes;

a plurality of metal connection members respectively mounted in said mounting holes of said heat sink and said through of said circuit board to fixedly secure said heat sink to said circuit board; and a lampshade comprising a body surrounding said circuit board and an open space surrounded by said body for the passing of said heat sink to the outside of said lampshade, wherein said heat sink comprises a plurality of vertically staggered rib structures, and wherein each said rib structure is formed of two said upright walls and one said horizontal wall between the two upright walls, and each said horizontal wall carries one said mounting hole.

* * * * *